United States Patent [19]

Brandeau

[11] Patent Number: 4,750,266

[45] Date of Patent: Jun. 14, 1988

[54] FLAT CABLE CONNECTOR ASSEMBLY

[76] Inventor: Edward P. Brandeau, Fall Mountain Ct., Martinsville, N.J. 08836

[21] Appl. No.: 9,086

[22] Filed: Jan. 27, 1987

Related U.S. Application Data

[63] Continuation of Ser. No. 633,898, Jul. 24, 1984, abandoned.

[51] Int. Cl.[4] ..... H01R 43/16; H01R 43/20

[52] U.S. Cl. ..... 29/884; 439/494

[58] Field of Search ..... 339/17 F, 176 MF, 97 R, 339/99 R, 256 R, 258 R, 176 SF; 29/884

[56] References Cited

U.S. PATENT DOCUMENTS

| | | | |
|---|---|---|---|
| 3,370,265 | 2/1968 | Berg | 339/256 |
| 3,544,954 | 12/1970 | Yeager | 339/258 R X |
| 4,083,615 | 4/1978 | Volinskie | 339/17 F |
| 4,157,612 | 6/1979 | Rainal | 339/176 MF X |
| 4,173,388 | 11/1979 | Brandeau | 339/176 T |
| 4,288,917 | 9/1981 | Brandeau | 29/860 |
| 4,342,498 | 8/1982 | Patton et al. | 339/256 R |
| 4,460,228 | 7/1984 | Lane et al. | 339/99 R |

OTHER PUBLICATIONS

Winings, C. L., "Printed Circuit Board Convertor Family With Up to 48 Contacts Per Inch of Board Height", Proceedings, 30th Electronics Components Conference, (1980), pp. 332–340.

Amer. Society for Metals, "Metals Handbook", 8th Ed., pp. 405–407.

*Primary Examiner*—Eugene F. Desmond

[57] ABSTRACT

An electronic connector assembly in which high performance output contacts arranged in almost any given spacing and sequence are integral with wire contacts to which multiple fine gage closely spaced ground and signal wires of a matched impedance flat cable are connected on wire centers. Changes in the number, gage and spacing of the wires, and in the wiring pattern, spacing and number of the "ground" and "signal" output contacts are easily accommodated. The output contacts and wire contacts are formed from a thin, flat piece of spring metal stock and may be handled during manufacturing as a unitary assembly thereby increasing quality and uniformity and decreasing cost.

2 Claims, 4 Drawing Sheets

FLAT CABLE CONNECTOR ASSEMBLY

This is a continuation of application Ser. No. 633,898, filed July 24, 1984, now abandoned.

BACKGROUND OF THE INVENTION

This invention relates to the connector-cable assemblies such as are used to make multiple interconnections between high speed circuits in computer, and similar electronic equipment.

Many present day electronic circuits (semiconductors, large scale integrated circuits, etc.) have much higher densities, and faster switching speeds, than circuits of only five years ago. These modern circuits produce signal pulses with nano second, or even sub-nanosecond rise times, and relatively low power. Where it is necessary to transmit with high integrity the signals from one circuit to another that is physically removed by some distance (e.g. five feet), present day practice frequently is to use a flat cable with multiple signal lines. Each line of the cable has an impedance that is closely matched to the impedance of the circuits it is interconnecting. This impedance matching is necessary to prevent undue amount of distortion, of attenuation, and of cross-talk of the low power electronic signals traveling along the line in the cable. Cables with impedances in the range from 50 to 95 ohms, and with from eight to forty signal lines are commonly used.

For reasons of mechanical, thermal and electronic performance, and also because of efficient size and installed cost advantage, a widely used type of matched impedance cable comprises a thin, flat ribbon of tough, low loss insulation, such as Teflon (Du Pont trademark). Buried in the insulation are many fine gage, closely spaced wires which serve as multiple transmission lines. The wires are usually arranged in triplets in which a center signal wire is closely paralleled on each side by a ground wire. The impedance of each "triplet" transmission line is determined by the effective dielectric constant of the insulation surrounding them, by the gage of the wires, and by their distance apart.

By way of example, and as an aid in understanding the invention described hereinafter, one such flat cable, which is widely used, comprises a thin ribbon of PTFE Teflon in which are buried sixty-six plated copper wires of 32 gage each. The wires are arranged in twenty-two "triplets" with all of the wires being evenly spaced and with a nominal 50 mil (50 thousandths of an inch) center-to-center spacing from signal wire to signal wire. The cable insulation is about 30 mils thick and 1.13 inch wide. The impedance of each triplet line is nominally the same ohmage (plus or minus a few percentage points because of manufacturing tolerances). This impedance is measured with sub-nanosecond rise-time pulses, which showed a propagation delay of slightly under 1.4 nanosecond per foot along ten feet of the cable.

In the inventor's previous patents, U.S. Pat. No. 4,173,388 and U.S. Pat. No. 4,288,917, there are described a contact device for, and a method of, mechanically terminating the fine gage wires of a flat cable. Very high reliability of the wire terminations made according to these prior patents was obtained. But various additional design considerations led to manufacturing and assembly complexities in changing to a different cable-connector combination in which there were many more wires, on much closer centers, and with a different "ground" and "signal" pattern for the output sockets.

One of the problems involved in designing a high performance electronic connector is how to provide output contacts which can repeatedly be plugged into or unplugged from the input-output (I-O) contacts of a circuit without undue mechanical wear or degradation of the electrical interface between connector and circuit. Typically, the I-O contacts of a circuit are 25 mil square "wire-wrap" posts on closely spaced columns and rows (e.g. tenth inch by tenth inch). These posts mate with connector contacts which include spring members that grip the posts and directly or indirectly, provide electrical connection. Because a connector may contain up to several dozen output contacts it is highly desirable that the insertion force of each contact onto a post be kept relatively low (e.g. several ounces). But the spring force holding a contact against a post must remain throughout its lifetime above the minimum force needed for a reliable, low resistance electrical connection. Even where gold is used at the interface of contact to post, these mechanical and electrical requirements are hard to meet. An excellent discussion of various important requirements of high performance output contacts in electronic connectors for critcal circuit application is given in an article titled "PRINTED-CIRCUIT-BOARD CONNECTOR FAMILY WITH UP TO FORTY-EIGHT CONTACTS PER INCH OF BOARD HEIGHT" by C. L. Winings of Bell Telephone Laboratories, published in the 1980 Proceedings, 30th Electronic Components Conference, pages 332 to 340.

One of the best ouput contacts for an electronic connector comprises a miniature box-like socket which plugs onto a 25 mil square I-O contact. Mounted within the body of the socket is a very small separate leaf spring which when the socket is on the post holds the body of the socket against the post with a controlled force. By choosing a suitable metal and appropriate geometry for the spring, the insertion force of the socket onto a post and its holding force when on the post are closely controlled to desired values. The body of the socket generally is formed from a metal which is easier to bend and less expensive than the metal of the separate spring. A high performance socket of this kind is shown in U.S. Pat. No. 3,370,265 to Berg.

Because the sequence or pattern of electrical "ground" and "signal" I-O contacts may vary from circuit to circuit, it is necessary to provide different patterns of ground and signal outputs for the connectors used with these circuits. Where the connector contacts are numerous and closely spaced in multiple rows, changing from one wiring pattern to another has previously been expensive and involved considerable "hand" labor in assembly. The present invention seeks to overcome these prior difficulties. This invention is highly useful in, but not limited to the connector arrangement described and claimed in the inventor's co-pending application Ser. No. 633,897, filed on even date herewith titled FLAT CABLE-CONNECTOR HAVING IMPROVED CONTACT SYSTEM.

It is an object of this invention to provide an electronic connector having multiple, high performance output sockets, the "ground" and "signal" pattern of the sockets being easily and inexpensively changed.

A further object of the invention is to provide an improved electronic connector which is also less expensive to manufacture and to assemble than previous similar connectors.

Still another object is to provide a manufacturing technique or method for electronic connectors which is highly versatile and inexpensive and yet gives precision and uniformity to the many critcal parts in the connector.

These and other objects of the invention will be understood from the following description given in connection with the accompanying drawings in which.

Figure 1:
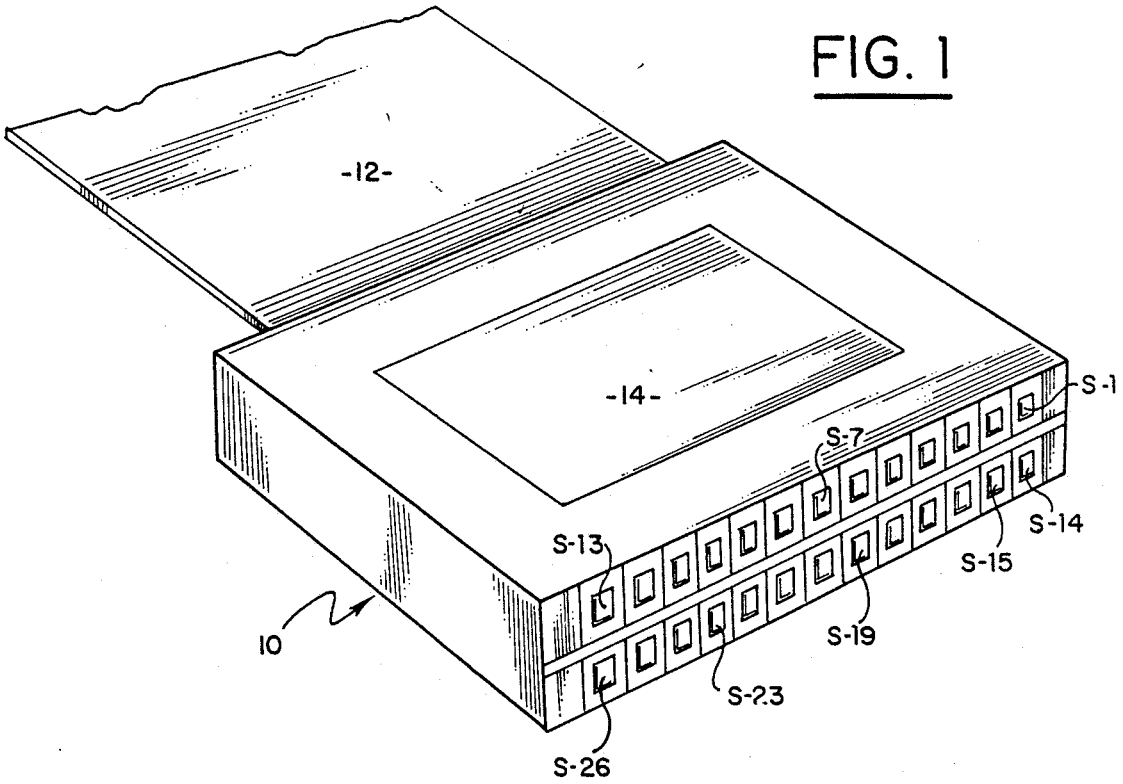
FIG. 1 is a perspective view of one end of a flat cable-connector assembly.

Referring now to the drawings, FIG. 1 shows a connector 10 in which are electrically terminated the many fine wires of a matched impedance flat cable 12. The connector comprises a thin, flat housing 14 of suitable insulating material (typically plastic) in which are contained and supported the conductive elements of the connector, the housing being tightly sealed or clamped onto the end of cable 12. It should be understood that the other end of the cable may be terminated in a similar connector (not shown).

The output of the connector comprises two rows of sockets, S-1 through S-13 in the upper row, and sockets S-14 through S-26 in the lower row. These sockets are intended to be plugged onto, or unplugged from, input or output contacts (I-O contacts) of an electronic circuit. Typically such contacts are standard 25 mil square posts on suitable column and row spacings. Here it is assumed they are on tenth inch by tenth inch centers.

Figure 2:
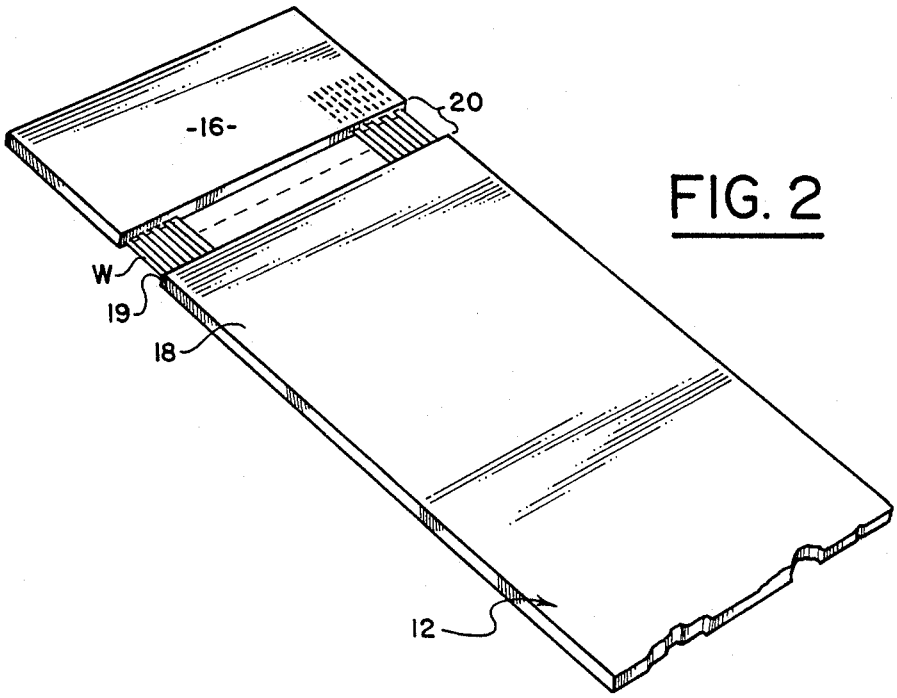
FIG. 2 is a perspective view of one end of the cable prior to termination in the connector, showing a tab of cable insulation pulled partly off at the end to expose a short length of the wires.

FIG. 2 shows a dressed end of cable 12 in which a tab 16 of insulation is cut from the cable insulation 18 at edge 19, and partly pulled off the ends of the cable wires W, thereby baring the wires for a short length in zone 20. The wires are straight and parallel in zone 20 and are held on their original centers by the cable insulation 18, and tab 16. The latter, along with the severed ends of wires W, will be discarded after the wires are terminated in the connector. Various makes of tools for dressing the ends of flat cables are commercially available. For a Teflon cable 1.13 inch wide, and having sixty-six 32 gage wires, a length for zone 20 of about 0.4 inch is adequate to permit the wires to be terminated in the connector according to the present invention. After the end of the cable is dressed, such end is put in an applicator tool, which is described in the inventor's co-pending patent application identified above. The tool has a wire comb which snugly fits over and partly around the cable wires holding them resiliently but firmly. Because of manufacturing tolerances, the right-most wire of the cable measured from the left-most wire, may actually be five to ten thousandths of an inch out of exact position. The tool comb corrects such minor variations and insures that all of the wires are on exact centers prior to terminating them. The wire terminating action of the tool is also described in said co-pending application.

Figure 3:
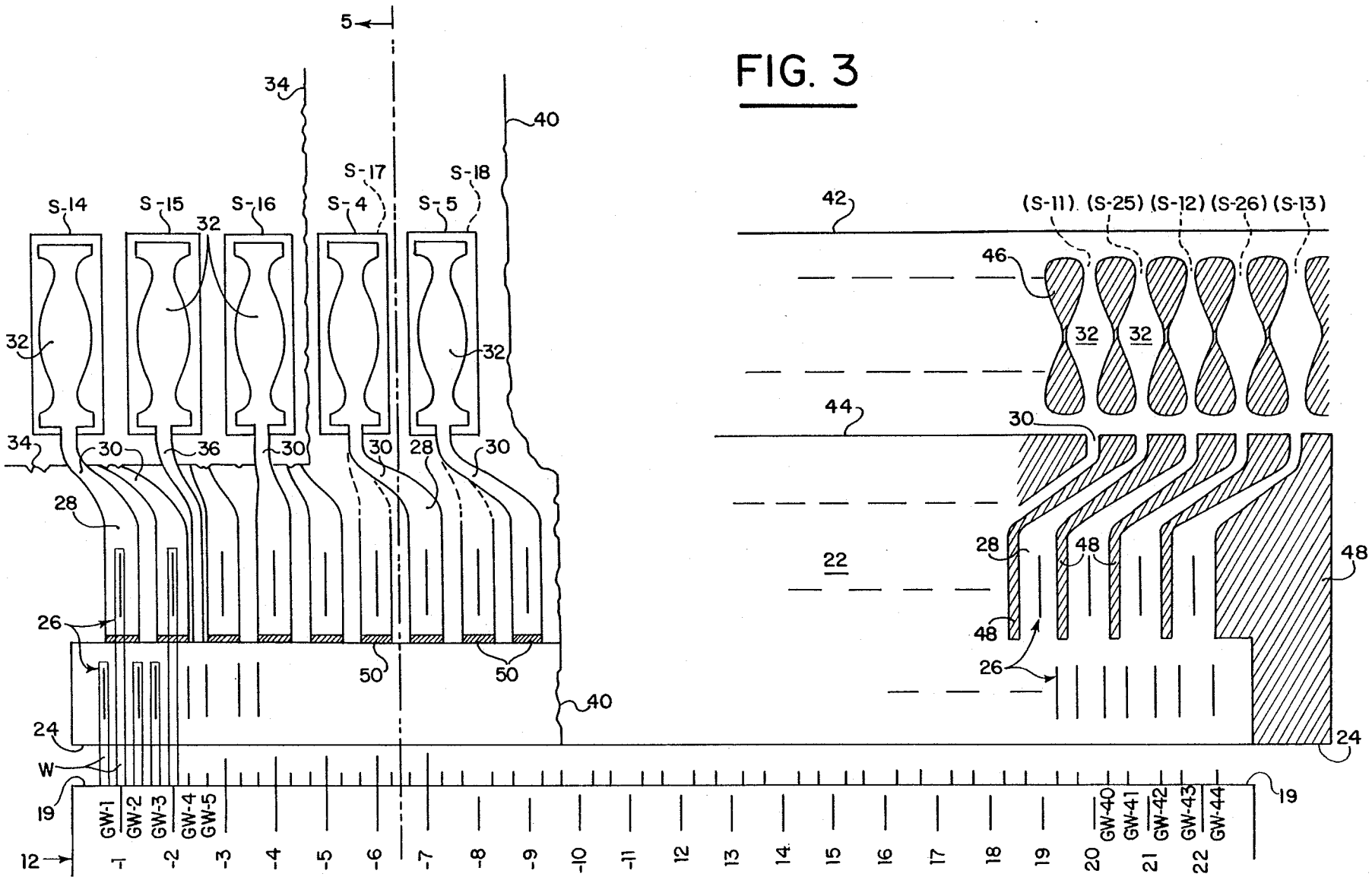
FIG. 3 is a plan view, approximately to ten times scale, showing somewhat schematically an array of high performance output sockets in the connector assembly according to this invention.

FIG. 3 shows in top plan view, approximately to ten times scale, an array 22 of wire contact devices and integral output spring contacts which are within connector housing 14. For simplicity, none of the housing is shown in this figure. This drawing is somewhat schematic to better illustrate the invention and to aid in understanding its simplicity. Array 22 is formed from what was originally a rectangular flat piece of thin metal stock having a uniform thickness. The array is nested in housing 14 (not shown here but shown in other figures) which is molded to fit the underside of the array. Portions of array 22 have not been completely drawn-in to illustrate that the original metal stock can easily be configured into the dimensions and profiles needed for any particular connector. It should be appreciated however, that array 22, up until the final stages of assembly of the connector may be handled as a unitary, single-piece assembly. This is a very important advantage in manufacturing.

As seen in FIG. 3, a tab end of cable 12 is positioned with its cut edge 19 closely adjacent and parallel to the long lower edge of 24 of array 22. Wires W of the cable (which are exposed in zone 20) lie parallel to and slightly above the top plane of the array. For simplicity in FIG. 3, only the five left-most wires of the cable are drawn-in. These comprise, at the extreme left, a ground wire with center line designated GW-1, then proceeding to the right a signal wire SW-1, a ground wire GW-2, another ground wire, GW-3 and a second signal wire SW-2. All of the wire as shown here are evenly spaced. The first three wires GW-1, SW-1, and GW-2, comprise a single "triplet" transmission line in cable 12. The next triplet comprises the next three wires, GW-3, SW-2 and GW-4. In the example shown here there are twenty-two signal wires (SW-1 to SW-22) and forty-four ground wires (GW-1 to GW-44), a total of sixty-six wires. The center lines of all the wires W are as indicated along and slightly below cable edge 19.

All of the sixty-six wires of the cable will be terminated simultaneously to array 22 in respective contact devices generally indicated at 26 in FIG. 3. Each contact 26 is positioned exactly under the corresponding wire to be terminated in it. These contact devices 26 are described in detail and claimed in the inventor's aforementioned co-pending patent application. They are arranged in closely spaced rows and columns, there being sixty-six contacts 26 corresponding to the sixty-six wires W in the cable illustrated. All of contacts 26 can be made in array 22 simultaneously, thus their true positions from left to right and bottom to top in the array are almost absolutely exact (within one thousandth of an inch).

As seen in FIG. 3, there are two left-to-right rows of contacts 26 in array 22. The contacts in the top row are where the signal wires (SW-1 to SW-22) are terminated. The contacts in the bottom row are where the ground wires (GW-1 to GW-44) are terminated and electically commoned. As seen best in the left and center of FIG.

3, each contact 26 (in the top row) intended for signal wires is generally centered in a respective arm 28. The top of each arm continues as a narrowed tail 30 which extends upward in the figure along its own separate, electrically isolated path of appropriate length and direction. Each tail 30 is integral with one of the output spring contacts, generally indicated at 32, contained within one of the output sockets to S-26. It is important to note here that each output spring contact 32 is integral with a respective "signal" or "ground" wire contact 26 even through the output contacts and the wire contacts may lie on different centers, in different lateral positions and on different levels.

The upper left portion of FIG. 3 has been broken away along wavy line 34 to show the lower row of output sockets of connector 10. Here, lower socket S-14 is seen to be connected via a signal tail 30 and an arm to signal wire SW-1, but the next socket S-15 is connected via a "ground" tail 36 to that portion of array 22 which electrically commons all of the ground wires of the cable. The lateral spacing between side-by-side signal arms 28 is easily sufficient for a "ground" tail to be provided between any two of them. Thus each output socket spring 32 is integral with a tail which may run either to "ground" or to "signal", as desired. To the right of break line 34 in FIG. 3 are shown two upper sockets S-4 and S-5, with lower socket S-17 and S-18 and their tail connections indicated by dotted lines. As will be additionally apparent from the description following, the output sequence of grounds and signals may be easily changed. Moreover, this sequence is essentially independent of the spacings of the wires W in cable 12, and vice versa. This ia a very important manufacturing advantage.

Figure 4:
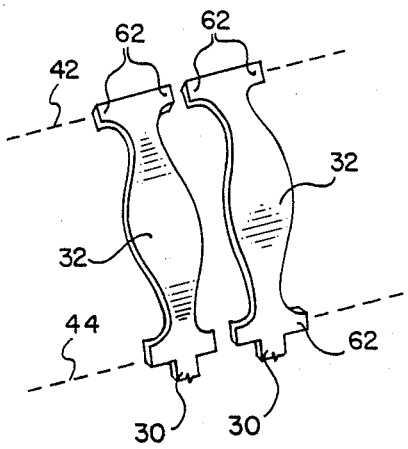
FIG. 4 is a perspective view of an upper right portion of FIG. 3 showing how a progression of output springs is formed from the connector array.

FIG. 3, to the right of wavy line 40, is further broken away to illustrate how output springs 32 and wire contacts 26 may be profiled and formed out of array 22 from a single, thin piece of metal stock. As seen in the upper right portion of FIG. 3, a sequence of output springs 32 is progressively formed from right-to-left in a zone between an upper line 42 and a lower line 44 by blanking out between the springs the "figure-eight" portions indicated by the shaded areas 46. As the springs are profiled, and as seen in FIG. 4, each two adjacent springs, one for an upper socket and one for a lower, are severed from each other and bent in opposite directions by stamping and forming tooling (not shown) of a kind well known in the art. The springs remain attached to their integral tails 30 (or 36) and thus do not fall loose form the array. In the example shown here, each spring at its maximum width is only half the center-to-center spacing of the sockets in connector 10; thus within this pitch (e.g. tenth inch) an "upper" and a "lower" spring can be formed.

As seen in FIG. 3 in the right-to-left zone between the lower edge 24 of array 22 and line 44, wire contacts 26 are formed independently of the output sockets. Signal arms 28, their tails 30 (and ground tails 36 where desired) are profiled by removing the shaded area 48 as indicated. These areas are preferably defined photographically and removed by known printing and etching procedures, particularly since the thin metal array 22 lends itself well to this technique. Subsequent to the profiling of springs 32, tails 30 (and 36) and arms 28, the lower output socket springs will be moved down and shifted right, and the upper springs moved up and shifted left so that they are positioned one over the other in two rows and precisely on socket centers. Signal tails 30, and ground tails 36, are easily bent to accomplish this positioning of the output springs. As seen in the left lower portion of FIG. 3 signal arms 28, at a stage of connector assembly before the wires W are terminated, are electrically isolated from the remainder of array 22 by removing the metal at the roots of arms 28 indicated by shaded zones 50. This is further explained in connection with FIG. 4 above identified co-pending patent application.

Figure 5:
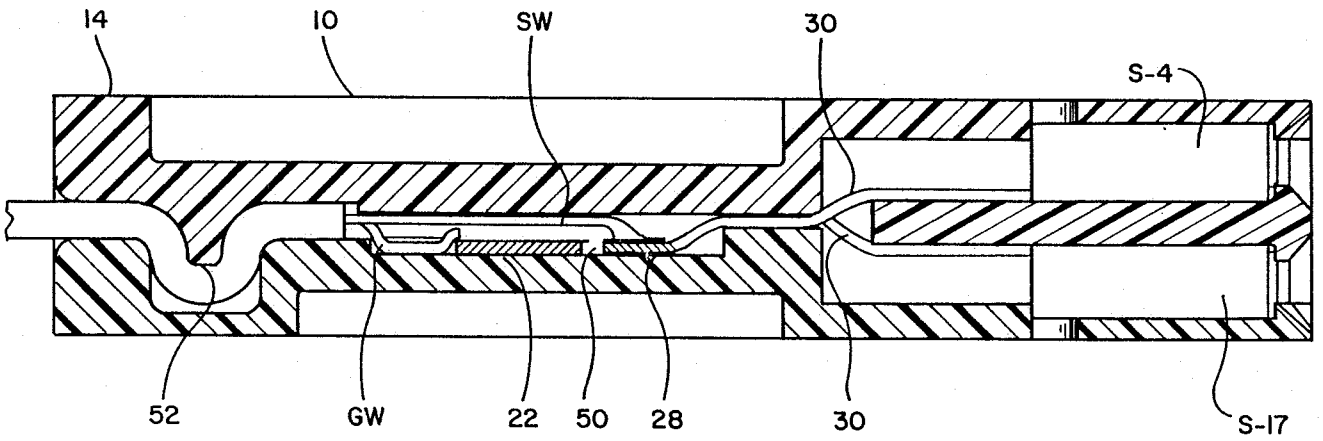
FIG. 5 is an enlarged cross-section, taken as indicated by lines 5—5 in FIG. 3 showing how portions of the socket and contact array lie in different planes in the connector.

FIG. 5 is a lengthwise cross-section of the connector taken as indicated by lines 5—5 in FIG. 3. As seen in FIG. 5, an upper output socket is positioned within connector housing 14 directly over a lower socket, here indicated as sockets S-4 and S-17. Each socket is connected by its tail 30 (or 36) to contact array 22, whose signal arms and common ground part are supported in the same general plane by housing 14. Signal wires SW and ground wires GW are connected to array 22 as indicated here. They are terminated on their original cable centers to the array and are advantageously gang terminated to contact 26 as described and claimed in the inventor's aforementioned patent application. Cable 12 is mechanically secured within housing 14 by a strain relief rib indicated at 52 after the wires have been terminated and the connector housing closed together.

Figure 6:
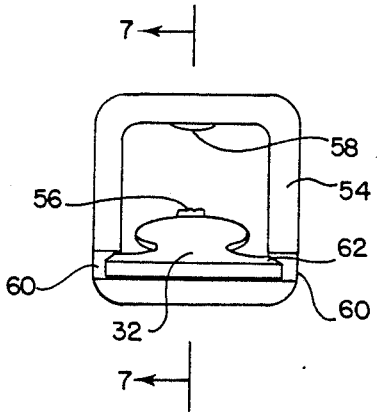
FIG. 6 is an end view of one of the output sockets of the connector.
Figure 7:
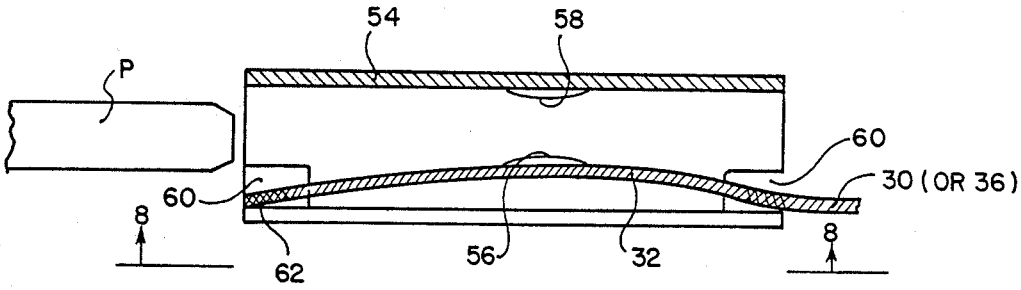
FIG. 7 is a cross-section of the socket taken as indicated by lines 7—7 in FIG. 6.

FIG. 6 is an end view of one of the output sockets. Here an output spring 32 is captivated within a long hollow, generally rectangular box 54. The box is formed from thin sheet metal bent into a "square" shape. Spring 32, as seen also in FIG. 7 is bowed convexly upward within box 54. When an I-O contact post, such as post P, is inserted in the socket, the center part of spring 32 deflects down and bears against the post with a pre-designed carefully controlled force. Box 54 provides a mechanical support for post P which will not substantially yield in service against the force of spring 32 on the post. If ordinary plastic were used to support the post, there would be objectionable "creep" and the force of the spring against post would in time be degraded to an unacceptably low value. Spring 32 and box 54 near their centers where they bear against a post P may be selectively plated with gold, as indicated at 56 and 58.

Figure 8:
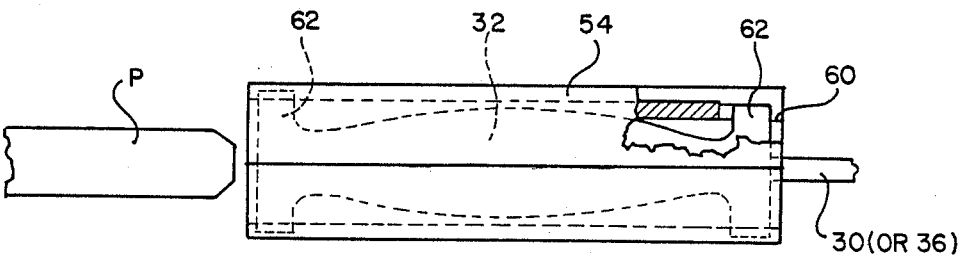
FIG. 8 is a bottom view of the socket taken as indicated by lines 8—8 in FIG. 7, and with one corner broken away to show how the contact spring is retained in the socket housing.

As seen in FIGS. 6, 7 and 8, box 54 at its two lower front and two lower rear corners is cut away at notches 60. Loosely trapped in these notches 60 are four "ear-like" ends 62 of spring 32. Thus the spring is free to flex within box 54 but cannot fall or be pushed out of the socket.

Array 22 is made of metal having a thickness, temper and strength particularly suitable for output springs 32. A suitable material is Cabot-Berylco #25, heat treated to yield strength of about 160,000 psi. A small, rectangular piece of this material about 6 mils thick is suitable for array 22 in the connector described herein. Advantageously, array 22 with ground and signal contacts, ground and signal tails, output springs 32, with box members 54 captivated around their respective springs, is handled as an integral, three-dimensional sub-assembly. As such it is inserted into housing 14 and heat staked or otherwise fastened in place. Then, the signal contact arms 28 are severed from array 22 by removal of zones 50 (FIG. 3). In this way, the number of parts which must be handled as loose pieces is substantially reduced, and the original, very high dimensional precision of the array is carried over into the connector. This results in extremely high uniformity from the first to the nth connector being manufactured.

As mentioned above, the output box sockets of connector 10 comprise leaf springs 32 and box member 54. Each socket is identical to its neighbors and may be placed on one-tenth inch centers (as shown) or on one-eighth inch centers. The number of sockets per row may easily be more or less than the number shown without affecting the socket manufacturing tooling. To change the sequence of grounds and signals of the output sockets involves only changes in a photographic pattern of the ground and signal tails. Contacts 26 are advantageously formed by manufacturing tooling which is independent of the other manufacturing tooling. Thus, as explained in the inventor's co-pending patent application, the contacts are formed in array 22 with a high degree of dimensional precision, but can easily be changed in number and spacing to accomodate the wires of different cables.

It will be appreciated by those skilled in the art that the connector and contacts provided according to this invention represent a substantial improvement in reliability, in manufacturability, and in ease of assembly over connectors known previously. Various minor changes in the materials, dimensions and geometry of the embodiment of the invention illustrated may be made without departing from the spirit or scope of the invention as set forth.

I claim:

1. An improved method of forming and assembling the output sockets and the input wire contacts of an electronic connector wherein the spacing and the sequence of ground and signal output sockets are substantially different from the spacing and sequence of the ground and signal wires of a matched impedance flat cable, said method comprising the steps of profiling a portion of a thin flat piece of metal suitable as part of output spring sockets into a side-by-side progression narrow elongated leaf springs, profiling another portion of said metal as integral parts of the springs into an equal plurality of narrow curved tails, each tail having its own respective path from its output spring to a wire contact portion of the metal, profiling another portion of the metal to give ground and signal wire contact devices spaced on wire centers, bending said tails orthogonally and sidewise to place side-by-side leaf springs in sockets orthogonally opposite each other, and mounting said output and input contacts in an insulating housing, whereby changes in ground and signal wiring patterns are easily made and multiple parts of the connector are easily assembled.

2. The method of claim 1 wherein the thin metal is copper alloy about six mils thick and is profiled at least in part by photographic printing and etching.

* * * * *